US010126023B2

(12) United States Patent
Yuan

(10) Patent No.: US 10,126,023 B2
(45) Date of Patent: Nov. 13, 2018

(54) MULTISTAGE PULSE TUBE COOLERS

(71) Applicant: The Aerospace Corporation, El Segundo, CA (US)

(72) Inventor: Sidney W. K. Yuan, Los Angeles, CA (US)

(73) Assignee: The Aerospace Corporation, El Segundo, CA (US)

( * ) Notice: Subject to any disclaimer, the term of this patent is extended or adjusted under 35 U.S.C. 154(b) by 728 days.

(21) Appl. No.: 14/626,596

(22) Filed: Feb. 19, 2015

(65) Prior Publication Data

US 2016/0245553 A1 Aug. 25, 2016

(51) Int. Cl.
*F25B 9/06* (2006.01)
*F25B 9/14* (2006.01)
(Continued)

(52) U.S. Cl.
CPC ..... *F25B 9/10* (2013.01); *F25B 9/145* (2013.01); *F25B 2309/1408* (2013.01);
(Continued)

(58) Field of Classification Search
CPC .... F25B 9/00; F25B 9/145; F25B 2309/1411; F25B 2309/1414; F25B 2309/1421;
(Continued)

(56) References Cited

U.S. PATENT DOCUMENTS 5,107,683 A 4/1992 Chan et al.
5,711,156 A 1/1998 Matsui et al.
(Continued)

FOREIGN PATENT DOCUMENTS

EP 1503154 B1 9/2009
WO WO 2003/060390 A1 7/2003

OTHER PUBLICATIONS

Banjare, Yamuna Prasad. "Theoretical and Experimental Studies on Pulse Tube Refrigerator," A Thesis Submitted for the Award of the Degree of Doctor of Philosophy, Department of Mechanical Engineering, National Institute of Technology Rourkela.
(Continued)

*Primary Examiner* — Frantz Jules
*Assistant Examiner* — Erik Mendoza-Wilkenfe
(74) *Attorney, Agent, or Firm* — K & L Gates LLP

(57) ABSTRACT

Various embodiments are directed to a pulse tube cooler. The pulse tube cooler may comprise a fluid compressor, a first regenerator, a first pulse tube, a first reservoir, a second regenerator, a second pulse tube, and a second reservoir. The first end of the first regenerator may be in fluid communication with the fluid compressor. The cold end of the first pulse tube may be in fluid communication with the second end of the first regenerator. The first reservoir may be in fluid communication with the hot end of the first pulse tube. The first end of the second regenerator may be in fluid communication with the cold end of the first regenerator. The cold end of the second pulse tube may be in fluid communication with the second end of the second regenerator. The cold end of the first pulse tube and the hot end of the second pulse tube may be in fluid communication with one another through the second reservoir.

27 Claims, 12 Drawing Sheets

(51) Int. Cl.
*F25B 9/00* (2006.01)
*F25B 9/10* (2006.01)

(52) U.S. Cl.
CPC ..... *F25B 2309/1419* (2013.01); *F25B 2309/1423* (2013.01); *F25B 2309/1424* (2013.01)

(58) Field of Classification Search
CPC ..... F25B 2309/1423; F25B 2309/1424; F25B 2309/14241; F25B 2309/1425; F25B 2309/1426; F25B 2309/1427; F25B 9/10; F25B 9/06; F25B 2309/1402; F25B 2309/1403; F25B 2309/1405; F15B 2309/1408
See application file for complete search history.

(56) References Cited

U.S. PATENT DOCUMENTS 6,256,998 B1 * 7/2001 Gao ..... F25B 9/145 62/6
6,629,418 B1 10/2003 Gao et al.
6,865,894 B1 * 3/2005 Olson ..... F25B 9/145 60/520
6,983,610 B1 1/2006 Olson
7,363,767 B2 4/2008 Wang
7,497,084 B2 3/2009 Xu et al.
8,397,520 B2 3/2013 Yuan et al.
8,408,014 B2 4/2013 Yuan et al.
8,418,479 B2 4/2013 Xu et al.
8,474,272 B2 7/2013 Yuan et al.
2008/0256958 A1 10/2008 Xu
2009/0084114 A1 4/2009 Yuan et al.
2009/0084115 A1 4/2009 Yuan et al.
2009/0084116 A1 4/2009 Yuan et al.
2009/0173083 A1 7/2009 Xu et al.
2011/0000225 A1 * 1/2011 Xu ..... F25B 9/145 62/6
2011/0100022 A1 5/2011 Yuan et al.
2011/0100023 A1 5/2011 Yuan et al.
2011/0100024 A1 * 5/2011 Yuan ..... F25B 9/00 62/6
2013/0283823 A1 10/2013 Yuan et al.

OTHER PUBLICATIONS

Nguyen, T., R. Orsini, G. Toma, T. Pietrzak, E. Tward, "Two Stage Pulse Tube Cooler for Space Applications," Adv. in Cryogenic Engineering, vol. 49 8, Amer. Institute of Physics, Melville, NY (2003), p. 1347.
Radebaugh, Ray, "Pulse Tube Refrigerators," Crogenic Society of America Short Course Symposium, Portland, Oregon, Jul. 28, 1997, 72 pages.
Radebaugh et al., "Secondary Pulse Tubes and Regenerators for Coupling to Room-Temperature Phase Shifters in Multistage Pulse Tube Cryocoolers," *Cryocoolers*, v. 16, pp. 237-247 (2011).
Wang, C., "A Novel Three-Stage 4 K Pulse Tube Cryocooler," *Cryocoolers*, vol. 14, pp. 163-169 (2007).
X.B. Zhang, K.H. Zhang, L.M. Qiu, Z.H. Gan, X. Shen, S.J. Xiang, A Pulse Tube Cryocooler with a Cold Reservoir, Cryogenics 54 (2013) 30-36.

* cited by examiner

MULTISTAGE PULSE TUBE COOLERS

BACKGROUND

Mechanical devices are used for cooling, heating, and thermal transfer in various applications. For example, mechanical coolers are used to cool certain sensor elements, to cool materials during semiconductor fabrication, and to cool superconductors such as in Magnetic Resonance Imaging (MRI) systems. Mechanical coolers typically utilize a thermodynamic cycle (often involving the compression and expansion of a fluid) to shift heat and create cold portions that are useful for cooling. Cryocoolers are a class of mechanical coolers that can achieve cold temperatures in the cryogenic range (e.g., <~123 K). Different types of mechanical coolers may comprise various valves, thermal compressors, mechanical compressors, displacers, etc., to bring about expansion and compression of the working fluid.

Regenerative mechanical coolers operate by generating an oscillating pressure in a working fluid. Examples of regenerative coolers include Stirling coolers, Gifford-McMahon coolers and pulse tube coolers. Pulse tube coolers are advantageous in many applications because they do not include moving parts at the cold end, such as displacer pistons or valves. It is desirable, however, to create pulse tube coolers with increased efficiency and lower temperatures.

Pulse tube cryocoolers do not have moving parts at the cold end, such as displacer pistons or valves. To achieve the desired cooling, the combination of the phase control device and the reservoir cause a phase shift between mass waves and pressure waves generated by the compressor. By varying the mass flow to the buffer volume, the phase control device may serve to shift the phase of the mass flow relative to the pressure wave generated by the compressor.

Multistage pulse tube coolers are used to achieve temperatures colder than can be achieved with a single cooler alone. Multistage coolers can be arranged in series, where the first stage regenerator is connected to the hot end of the second stage regenerator, or in parallel, where the cold end of the first stage pulse tube is connected to the hot end of the second stage pulse tube. Some load shifting between stages can be brought about by varying the frequency, charge pressure and/or temperature of each stage.

FIGURES

Various embodiments of the present invention are described here by way of example in conjunction with the following figures, wherein.

DESCRIPTION

Figure 1:
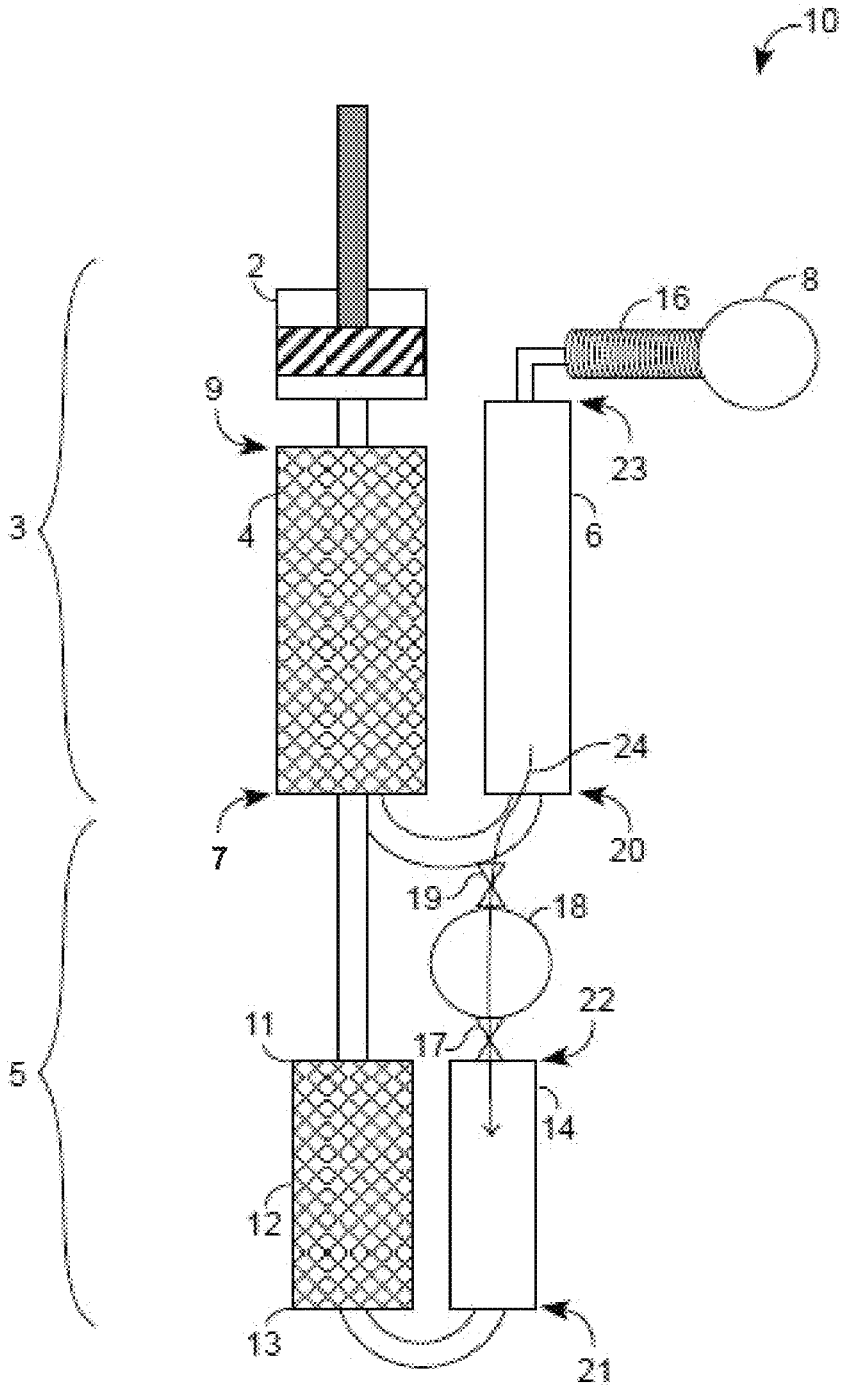
FIG. 1 illustrates one example of a multi-stage pulse tube cooler with a common reservoir.

FIG. 1 illustrates one example of a multi-stage pulse tube cooler 10 with a common reservoir 18. The pulse tube cooler 10 comprises a compressor that performs pressure-volume work (PV work) on a working fluid. A first stage 3 of the pulse tube cooler 10 comprises a regenerator 4, a pulse tube 6 and a reservoir 8. An first end 9 of the regenerator 4 is in fluid communication with a compressor 2. A second end 7 of the regenerator 4 is in fluid communication with a cold end 20 of a first stage pulse tube 6. A hot end 23 of the pulse tube 6 is in fluid communication with a reservoir 8 via a phase control device 16 such as, for example, an inertance or resistive device. The second stage 5 may comprise a regenerator 12, a pulse tube 14. A first end 11 of the regenerator 12 may be in fluid communication with the second end 7 of the first stage regenerator 4 and/or the cold end 20 of the first stage pulse tube 6. A second end 13 of the regenerator 12 may be in fluid communication with a cold end 21 of the pulse tube 14. A hot end 22 of the pulse tube 14 may be in fluid communication with a common reservoir 18, for example, via a phase control device 17. As illustrated, the cold end 20 of the first stage pulse tube 6 may also be in fluid communication with the common reservoir 18, for example, via a phase control device 19. In this way, as illustrated, the cold end 20 of the first stage pulse tube 6 is in fluid communication with the hot end 22 of the second stage pulse tube 14 through the common reservoir 18. For example, a fluid flow path, indicated by arrow 24, may be present from the cold end 20 of the first stage pulse tube 6 to the hot end of the second stage pulse tube 14.

The common reservoir 18 configuration illustrated in FIG. 1 may improve the performance of the pulse tube cooler 10 for a number of reasons. For example, fluid communication between the hot end 22 of the second stage pulse tube 14 and the cold end 20 of the first stage pulse tube 6 may drive down the temperature of the hot end 22 of the second stage pulse tube 14. This may, in turn, cause the cold end 21 of the second stage pulse tube 14 to reach colder temperatures than it otherwise would. Also, in some examples, the common reservoir 18 may provide an outlet for working fluid from the cold end 20 of the first stage pulse tube 6. This may allow additional expansion of the working fluid at the cold end 20, which can increase the achievable temperature gradient and thereby increase cooling capacity of the first stage 3 and the pulse tube cooler 10 as a whole.

Figure 2:
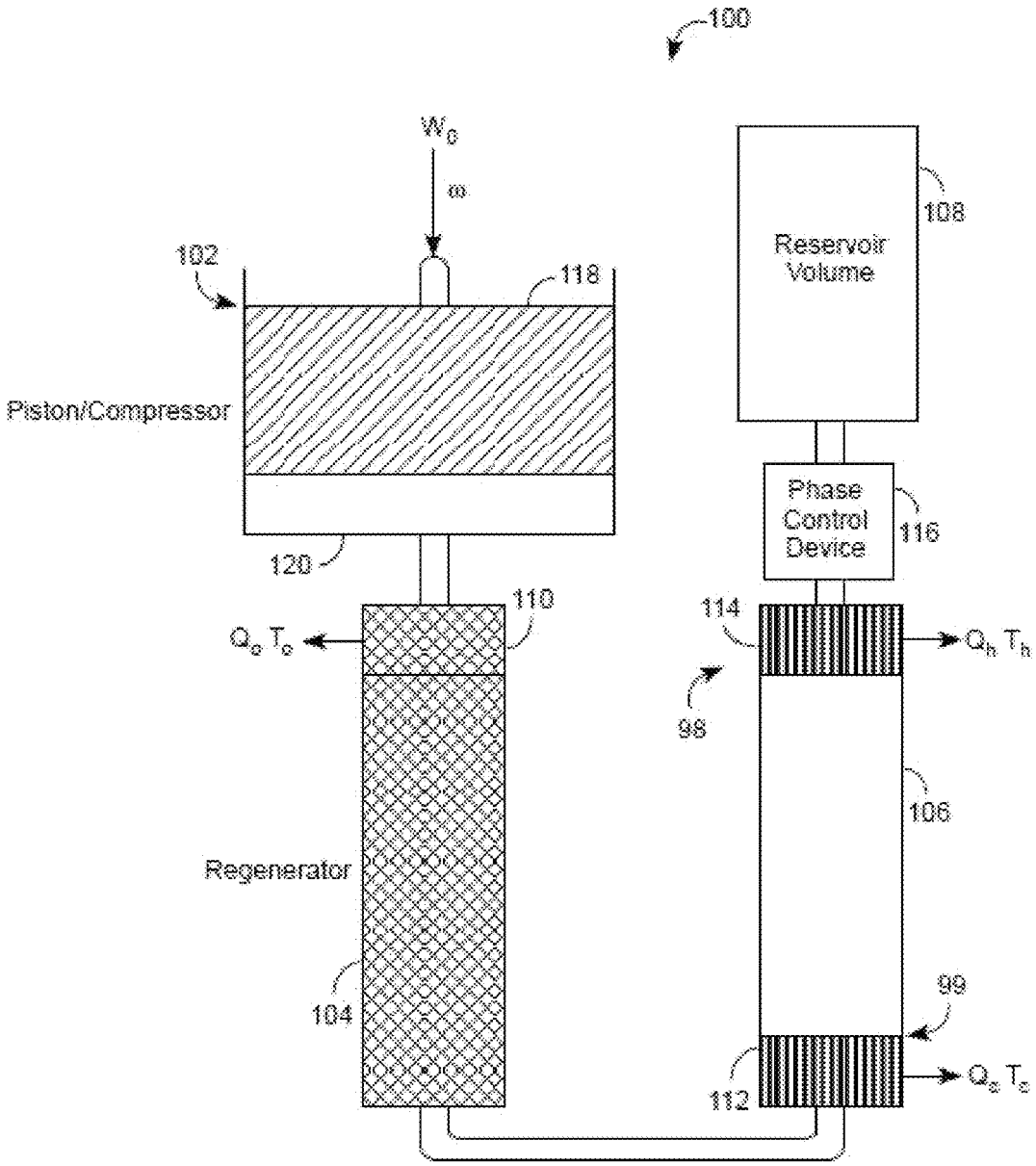
FIG. 2 illustrates one example of a single stage pulse tube cooler to demonstrate its operation.

FIG. 2 illustrates one example of a single stage pulse tube cooler 100 to demonstrate its operation. For example, the various components 2, 4, 6, 8, 12, 14, etc. of the pulse tube cooler 10 may operate in a manner similar to that described with respect to the pulse tube cooler 100. The cooler 100 comprises a compressor 102, a regenerator 104, a pulse tube 106 and a reservoir 108. The regenerator 104, pulse tube 106 and reservoir 108 may be filled with a working fluid, which may be an ideal gas such as helium. The compressor 102 may be and/or comprise any suitable device for performing pressure-volume work (PV work) on the working fluid. In the example shown in FIG. 2, the compressor 102 comprises a cylinder 120 with a reciprocating piston 118 therein. In some examples, the compressor 102 may be or comprise a rotary compressor, a linear compressor, an acoustic compressor, etc. The compressor 102 may be in fluid communication with the regenerator 104. The regenerator 104 may be in fluid communication with a cold end 99 of the pulse tube 106. A hot end 98 of the pulse tube 106 may be in fluid communication with a reservoir 108 via a phase control device 116. The phase control device 116 may comprise one or more sub-devices having an inertance and/or a resistance to the flow of working fluid, as described herein. The phase control device 116 may be embodied as one or more separate components, as a portion of the pulse tube 106, as a portion of the reservoir 108, or as any combination thereof.

The compressor 102, may drive the thermodynamic cycle of the cooler 100 at any suitable frequencies. For example, one thermodynamic cycle of the cooler 100 may correspond to one complete cycle of the piston 118 or other mechanism of the compressor 102. According to the thermodynamic cycle of the cooler 100, the compressor 102 may provide work $W_o$ to compress a portion of the working fluid, adding heat $Q_o$ and causing the temperature $T_o$ of the working fluid to rise at a heat exchanger 110. As the compressor 102 further compresses the working fluid, warm working fluid is passed through the regenerator 104 where part of the heat of compression $Q_o$ is removed and stored. Working fluid already present in the pulse tube 106 may be at a relatively lower pressure than that entering the pulse tube via 106 via the regenerator 104. Accordingly, the working fluid entering the pulse tube 106 via the regenerator 104 may expand in the pulse tube 106, causing cooling $Q_c$ at a heat exchanger 112 at a temperature $T_c$. Excess pressure in the pulse tube 106 from the expansion may be relieved across the phase control device 116 into the reservoir 108.

As the cycle continues, the compressor 102 reverses and begins to draw the working fluid from the cold end 99 of the pulse tube 106 back through the regenerator 104, where the stored heat is reintroduced. Resulting low pressure in the pulse tube 106 also causes working fluid from the reservoir 108 to be drawn across the phase control device 116 into the pulse tube 106. This working fluid from the reservoir 108 is at a higher pressure than that already in the pulse tube 106 and, therefore, enters with heat energy $Q_h$ and at a temperature $T_h$ that is relatively warmer than that of the other working fluid in the pulse tube 106. A new cycle may begin as the compressor 102 again reverses and begins to compress the working fluid. Examples of the operation of pulse tube coolers are provided in commonly assigned U.S. Patent Application Publication Nos. 2009/0084114, 2009/0084115 and 2009/0084116, which are incorporated herein by reference in their entirety.

The performance of the pulse tube cooler 100 may depend on the phase shift generated between the pressure waves and mass flow waves generated by the compressor 102 in the working fluid. This phase shift is a function of the volume of the reservoir 108 and the inertance and/or flow resistance of the phase control device 116. To achieve optimal performance, the phase shift may be approximately 0°, or slightly negative, such that the mass wave and pressure wave roughly coincide at the coldest portion of the pulse tube 106 (e.g., the cold end 99). According to various embodiments, the mechanical/fluid flow properties causing the phase shift may behave in a fashion analogous to the properties of an inductor-resistor-capacitor (LRC) electronic circuit that cause phase shifts between voltage and current. In the context of the pulse tube cooler 100, resistance is analogous to the flow resistance impedance caused by the phase control device 116. Inductance is analogous to the inertance introduced by the phase control device 116. Capacitance is analogous to the heat capacity of the system and is a function of the geometry of the reservoir 108 and the heat capacity of the working fluid.

According to various examples, the phase control device 116 may comprise various components that introduce resistance and or inertance into the system. For example, the phase control device 116 may be and/or comprise an orifice or other resistive configuration for resisting the flow of working fluid. Resistance to fluid flow may contribute to a phase shift between the pressure wave and mass wave in the working fluid which contributes to cooling, as described herein. The flow resistance provided by an orifice may be a function of the size and shape of the orifice. For example, for a circular orifice, the resistance may depend on the orifice diameter. An orifice may be embodied as a part of the pulse tube 106, a part of the reservoir 106, a separate component, or any combination thereof.

In some examples, the phase control device 116 may be and/or comprise an a flow inertia or inertance device. An inertance device may modify the phase shift between mass and pressure waves in the pulse tube cooler 100 by alternately storing and then releasing energy in a manner similar to that of a capacitor of inductor. This inertial portion of the total flow impedance of an inertia device may cause phase shifts without introducing resistive losses like an orifice or other resistive device. Examples of inertance devices include inertance tubes and inertance gaps. An inertance tube is a long tube that may be coupled between the pulse tube 106 and the reservoir 108. In some examples, an inertance tube may be several meters in length. For space efficiency, inertance tubes may be coiled. By increasing the distance that the working fluid must traverse between the pulse tube 106 and the reservoir 108, an inertance tube increases the time that the working fluid takes to reach the reservoir 108, while only minimally affecting the timing of the pressure wave. In this way, an inertance tube may introduce a phase shift between the pressure wave and the mass wave, often while minimize resistive losses. For an example inertance tube, the inertance (L) and flow resistance (R) of the tube are given by Equations 1 and 2 below:

$$L = \frac{4l_t}{\pi \times d^2} \tag{1}$$

$$R = \frac{128 l_t \eta}{(\pi \times \rho \times d^4)} \tag{2}$$

In Equations (1) and (2), $l_t$ and d, respectively, are the length, diameter and internal volume of the inertance tube 204. Additionally, η and ρ are the viscosity and density of the working fluid, respectively. An inertance tube may be embodied as a portion of the pulse tube 106, a portion of the reservoir 108, a separate component, or any combination thereof.

Figure 3:
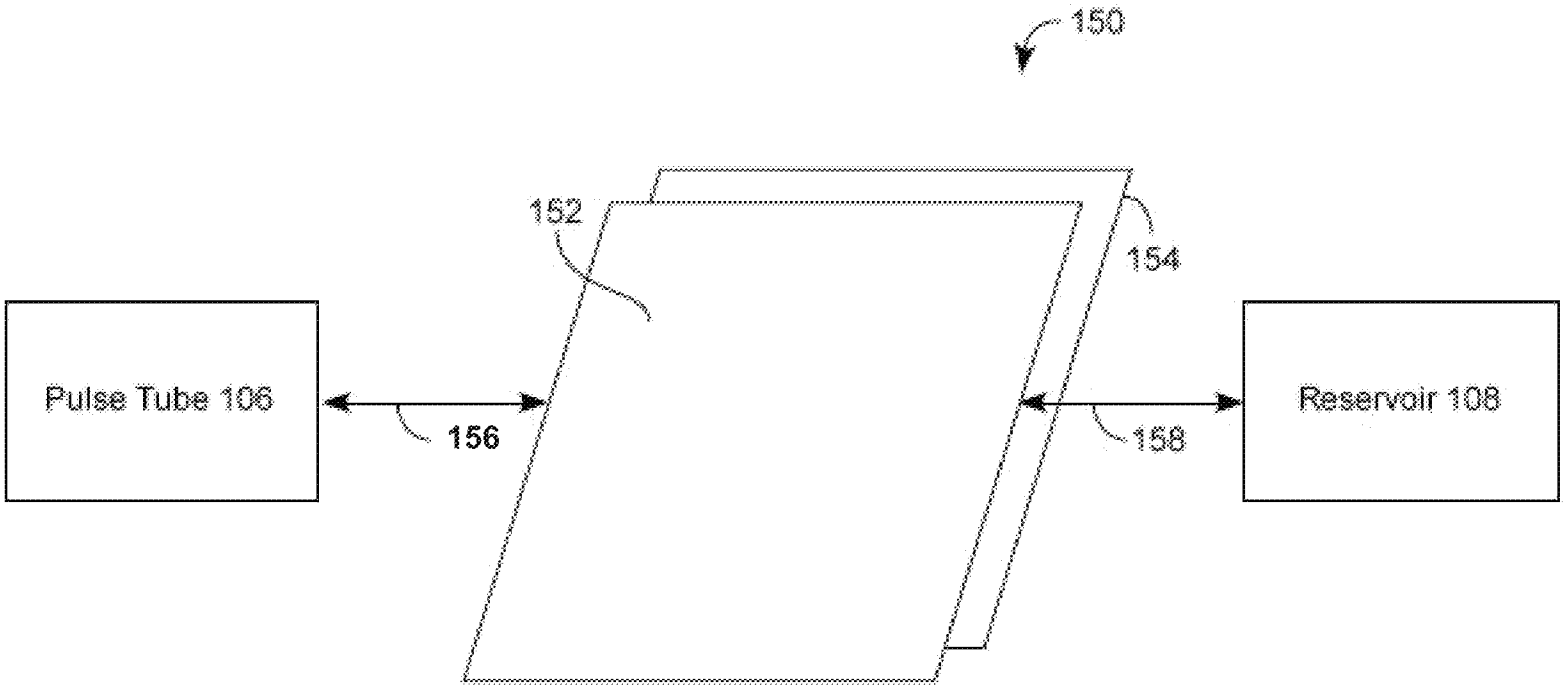
FIG. 3 illustrates one example configuration of an inertance gap device comprising parallel plates.

Another example of an inertance device is an inertance gap. An inertance gap may behave similarly to an inertance tube, but may have smaller physical dimensions. For example, while an inertance tube may be several meters long, an inertance gap device may have a length on the order of several inches. FIG. 3 illustrates one example configuration of an inertance gap device 150 comprising parallel plates 152, 154. The working fluid of the cooler 100 may pass between the parallel plates 152, 154 as it travels between the pulse tube 106 and the reservoir 108. The path of the working fluid through the inertance gap device 150 is indicated by arrows 156, 158. The inertance and flow resistance of the inertance gap geometry shown in FIG. 3 are given by Equations 3 and 4 below, where $l_g$, w and s are the length, width, and thickness of the gap.

$$L = \frac{l_g}{w \times s} \tag{3}$$

$$R = \frac{12 l_g \eta}{\rho \times w \times s^3} \tag{4}$$

Figure 4:
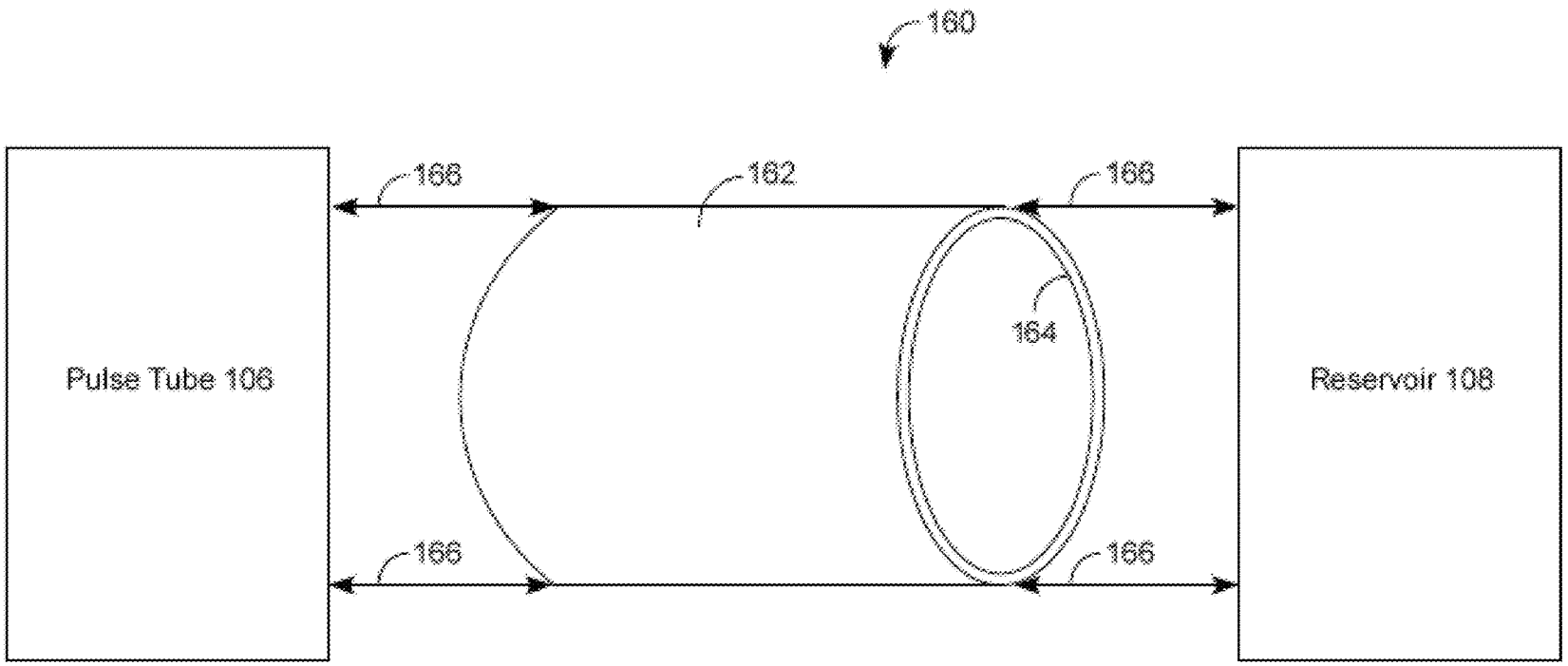
FIG. 4 illustrates another example configuration of an inertance gap device comprising concentric tubes.

FIG. 4 illustrates another example configuration of an inertance gap device 160 comprising concentric tubes 162, 164. The working fluid passes between the tubes on its way from the pulse tube 106 to the reservoir 108 and back. The path of the working fluid is indicated by arrows 166. The inertance and resistance of the gap geometry shown in FIG. 4 may be a function of the distance between the two concentric tubes 162, 164 and the length of the device 160.

Figure 5:
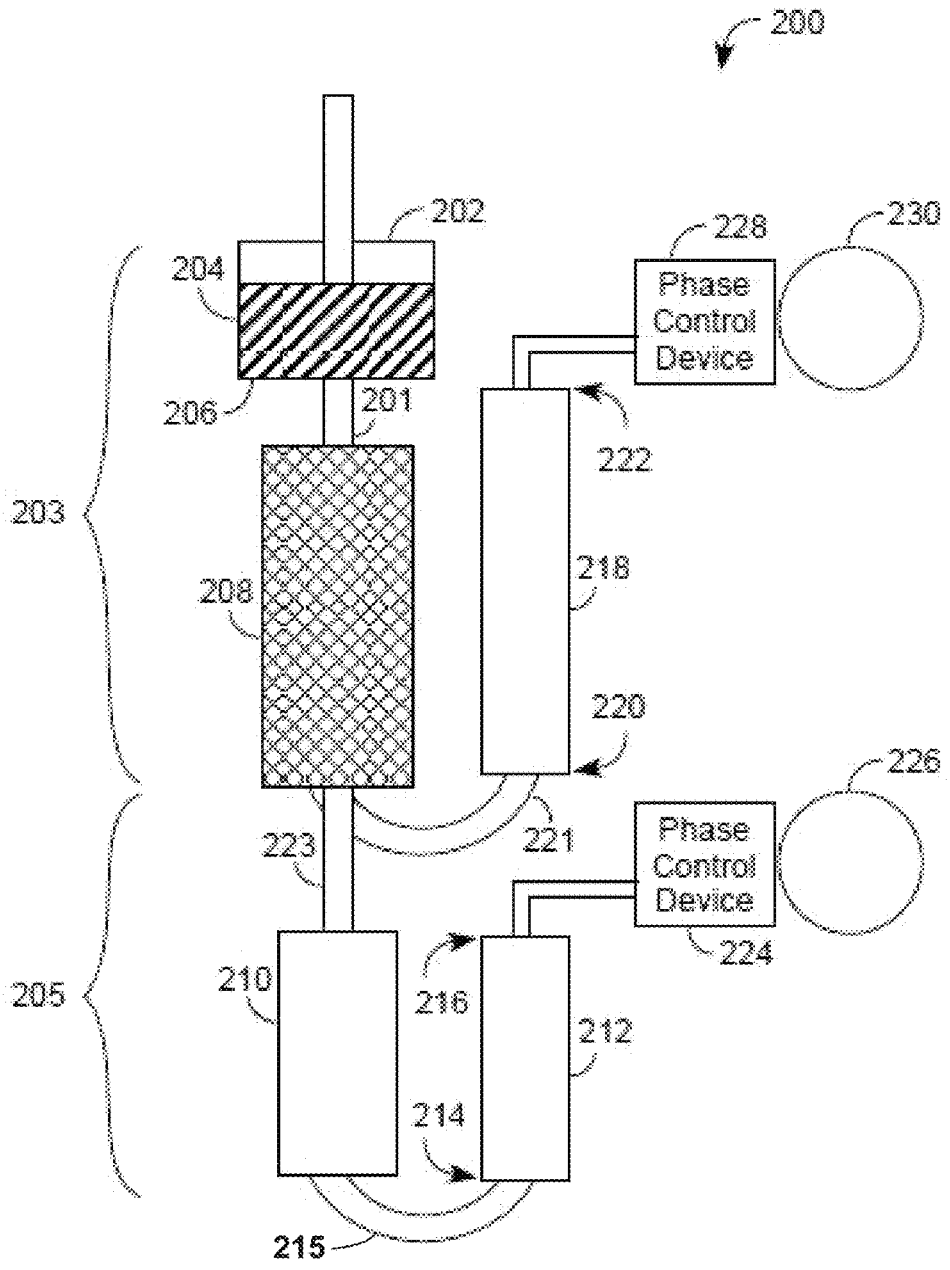
FIG. 5 illustrates one example of a multistage pulse tube cooler with two stages.

To decrease cold end temperature, it may be desirable to combine multiple pulse tube coolers into a multistage cooler. FIG. 5 illustrates one example of a multistage pulse tube cooler with two stages, 203, 205. A compressor 202 may comprise a piston 204 and a cylinder 206. The first stage 203 comprises a first stage regenerator 208, a first stage reservoir 230 and a first stage pulse tube 218 having a cold end 220 and a hot end 222. The compressor 202 and the first stage regenerator may be in fluid communication with one another, for example, via a tube 201. The pulse tube 218 and reservoir 230 are connected via a first stage phase control device 228, which may be a flow resistive orifice and/or an inertance device (e.g., tube or gap). The second stage 205 may comprise a second stage regenerator 210, a second stage reservoir 226 and a second stage pulse tube 212, which may have a hot end 216 and a cold end 214. The cold end 214 of the second stage pulse tube 212 may be in fluid communication with the second stage regenerator 210, for example, via tube 215. The second stage pulse tube 212 and the second stage reservoir 226 may also be connected via a phase control device 224. The phase control device 224, like the device 228, may be a flow resistive orifice and/or an inertance device. The cold end 220 of the first stage pulse tube 218 is in fluid communication with the second stage regenerator 210. For example, in the embodiment shown in FIG. 5, the cold end 220 of the first stage pulse tube 218 is connected to the second stage regenerator via tubes 221 and 223. Although only two stages are shown, it will be appreciated that coolers may be constructed with an arbitrary number of stages.

Figure 6A:
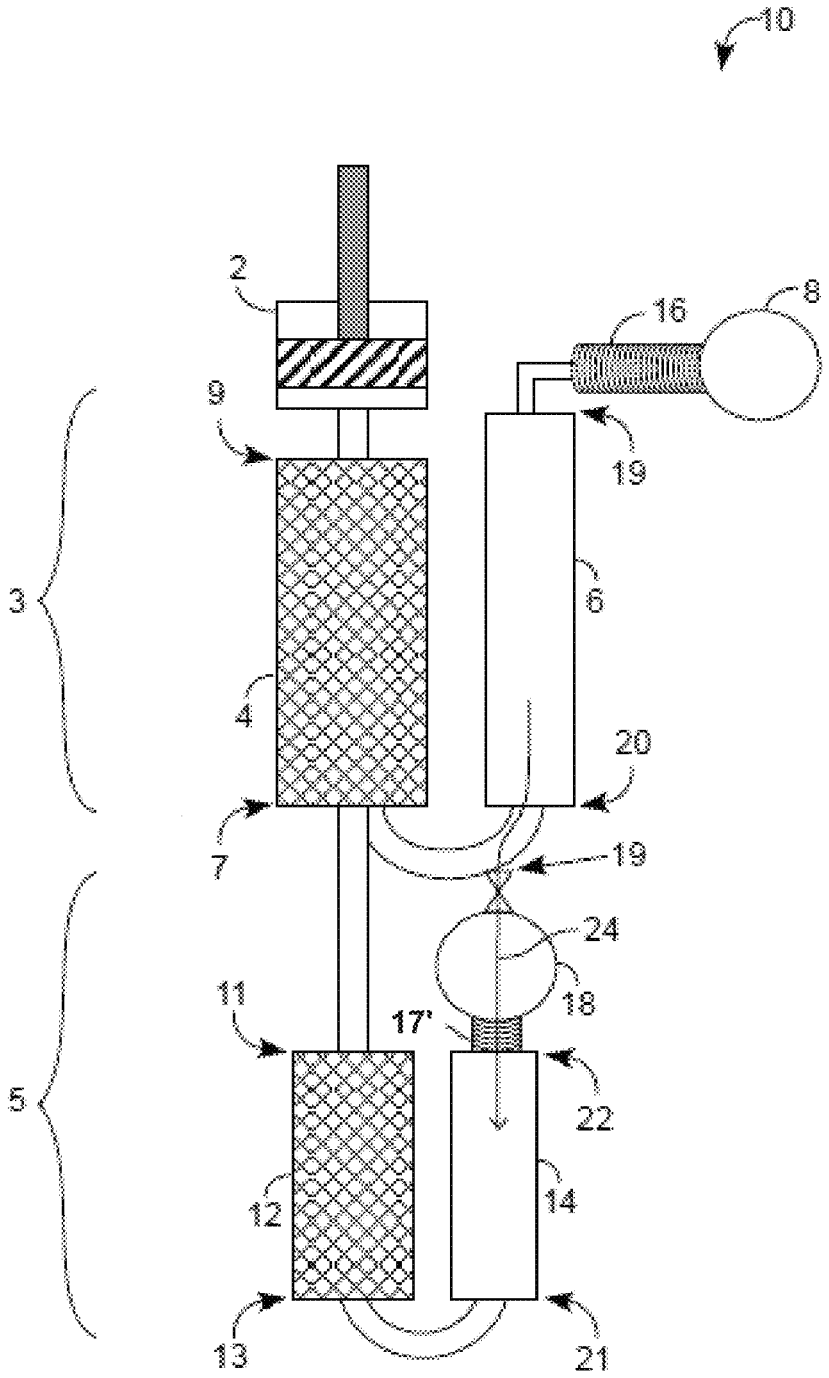
FIG. 6A illustrates one example of the pulse tube cooler of FIG. 1 where the phase control device between the common reservoir and the second stage pulse tube comprises an inertance device.
Figure 6B:
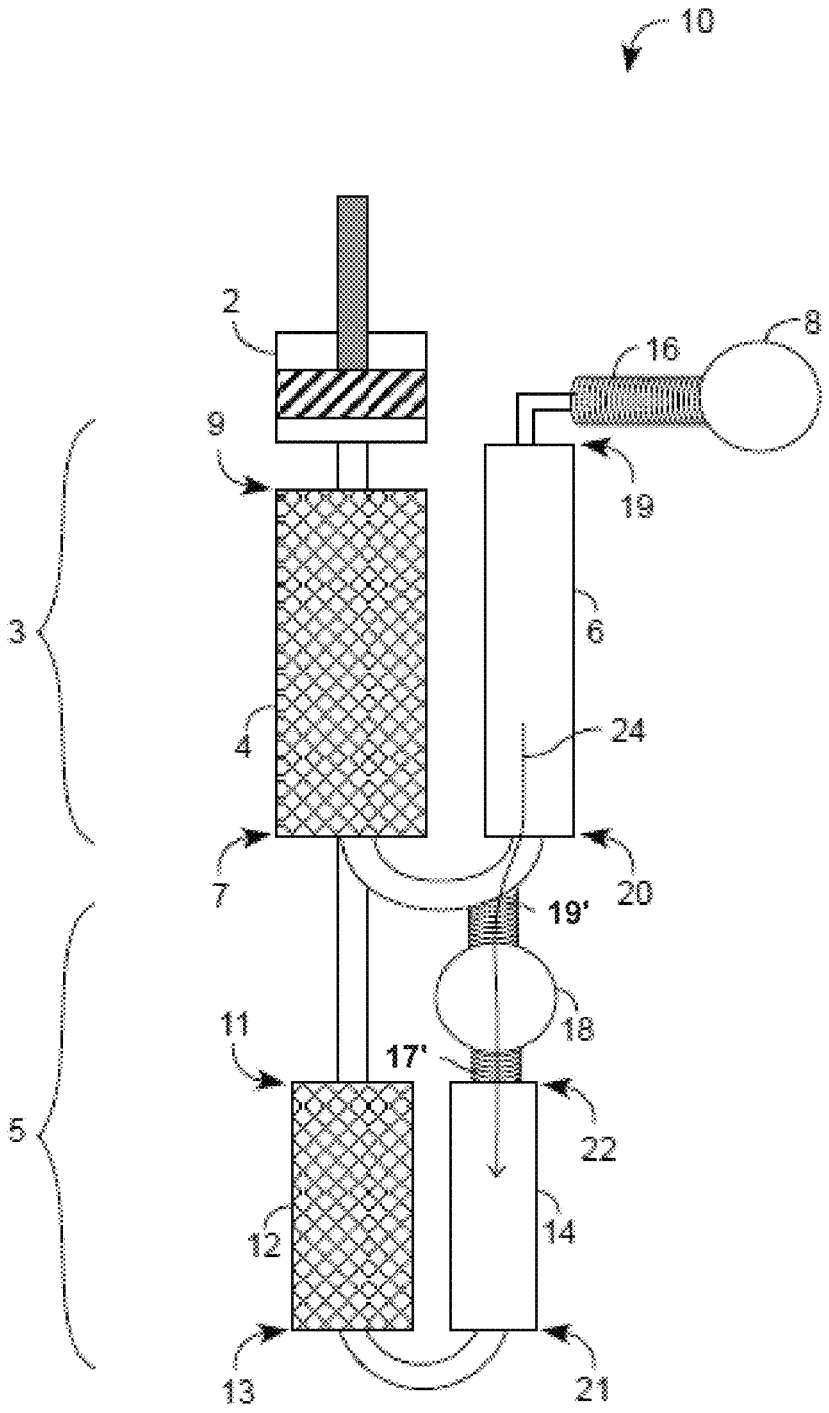
FIG. 6B illustrates one example of the pulse tube cooler of FIG. 1 where the phase control device between the common reservoir and the second stage pulse tube and the phase control device between the common reservoir and the first stage pulse tube comprise inertance devices.

Referring again to FIG. 1, the fluid flow path 24 between the cold end 20 of the first stage pulse tube 6 and the hot end 22 of the second stage pulse tube 14 may allow pressure and mass waves of the working fluid to propagate between the two components along the flow path 24. Phase control devices 17, 19 and the common reservoir 18 itself may regulate a phase shift between the pressure and mass waves between the pulse tubes 6, 14. The phase control devices 17, 19 may be any suitable type or combination of phase control devices including, for example, an orifice or other resistive device; an inertance tube, inertance gap or other inertance device, etc. For example, FIG. 6A illustrates one example of the pulse tube cooler 10 of FIG. 1 where the phase control device 17' comprises an inertance device. FIG. 6B illustrates one example of the pulse tube cooler 10 of FIG. 1 where the phase control device 17' and the phase control device 19' comprise inertance devices. Any suitable combination may be used. In some examples, both phase control devices 17, 19 may be inertance devices (FIG. 6B). In some examples, the phase control device 17 is a resistive device while the phase control device 19 is an inertance device.

In various embodiments, the common reservoir 18 may also serve as a flow inertia or inertance device on the flow path 24. For example, the large volume of the common reservoir 18 may slow mass waves more than pressure waves, increasing the phase difference between the two waves. The reservoir 18 may have any suitable volume. In some examples, the reservoir 18 may have a volume greater than or equal to between 25% and 100% of the volume of the second stage pulse tube 14. In some examples, the reservoir 18 may have a volume greater than or equal to the volume of the second stage pulse tube 14. In some examples, the reservoir 18 may have a volume greater than or equal to between one and two times the volume of the second stage pulse tube 14. In some examples, the reservoir 18 may have a volume greater than or equal to between two and three times the volume of the second stage pulse tube 14. In some examples, the reservoir 18 may have a volume greater than or equal to between three and five times the volume of the second stage pulse tube 14. In some examples, the reservoir 18 may have a volume that is between one and six times the volume of the second stage pulse tube 14. In some examples, the reservoir 18 may have a volume that is between two and six times the volume of the second stage pulse tube 14. In some examples, the common reservoir 18 may have a volume that is greater than six times the volume of the second stage pulse tube 14. In some examples, the reservoir 18 may have a volume that is greater than fifty times the volume of the second stage pulse tube 14, inclusive of sizes between the specific multiples provided herein. For example, the common reservoir 18 may have a volume between about six and about fifty times the volume of the second stage pulse tube 14.

The volume of the second stage pulse tube 14 and first stage pulse tube 6 may have the same volume or different volumes. For example, the second stage pulse tube 6 may have a volume different (e.g., smaller) than that of the first stage pulse tube 6. The volume of the common reservoir 18 may, then, also be expressed in terms of the volume of the first stage pulse tube 6. In some examples, the reservoir 18 may have a volume greater than or equal to between 25% and 100% of the volume of the first stage pulse tube 6. In some examples, the reservoir 18 may have a volume greater than or equal to the volume of the first stage pulse tube 6. In some examples, the reservoir 18 may have a volume greater than or equal to between one and two times the volume of the first stage pulse tube 6. In some examples, the reservoir 18 may have a volume greater than or equal to between two and three times the volume of the first stage pulse tube 6. In some examples, the reservoir 18 may have a volume greater than or equal to between three and five times the volume of the first stage pulse tube 6. In some examples, the reservoir 18 may have a volume that is between one and six times the volume of the first stage pulse tube 6. In some examples, the reservoir 18 may have a volume that is between two and six times the volume of the first stage pulse tube 6. In some examples, the common reservoir 18 may have a volume that is greater than six times the volume of the first stage pulse tube 6. In some examples, the reservoir 18 may have a volume that is greater than fifty times the volume of the first stage pulse tube 6, inclusive of sizes between the specific multiples provided herein.

Figure 7A:
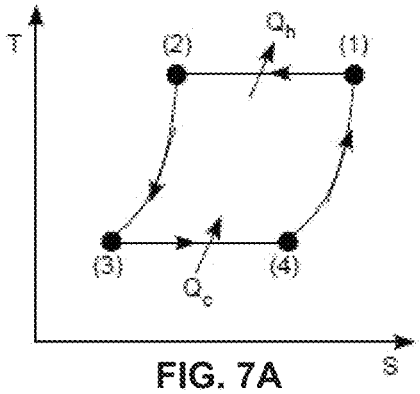
FIG. 7A shows a temperature (T)/Entropy (S) diagram of the thermodynamic cycle of the pulse tube cooler of FIG. 1.
Figure 7B:
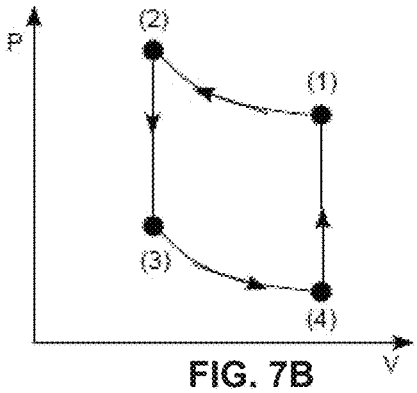
FIG. 7B shows a pressure (P)/volume (V) diagram of the thermodynamic cycle of the pulse tube cooler of FIG. 1.

FIGS. 7A-7B and 8A-8D illustrate an example thermodynamic cycle of a pulse tube cooler such as the cooler 10. FIG. 7A shows a temperature (T)/Entropy (S) diagram of the thermodynamic cycle of the pulse tube cooler 10. FIG. 7B shows a pressure (P)/volume (V) diagram of the thermodynamic cycle of the pulse tube cooler 10. FIGS. 8A-8D show configurations of the pulse tube cooler 10 at various points in the thermodynamic cycle of FIGS. 7A-7B.

Figure 8A:
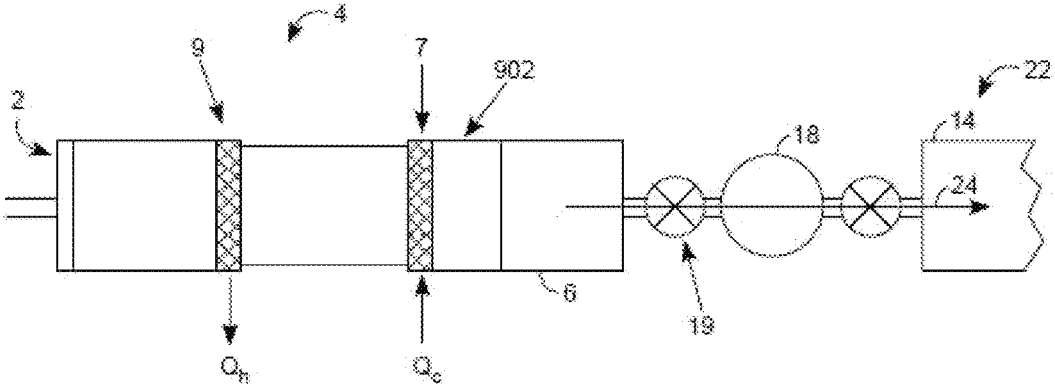
FIGS. 8A-8D show configurations of the pulse tube cooler of FIG. 1 at various points in the thermodynamic cycle of FIGS. 7A-7B.
Figure 8B:
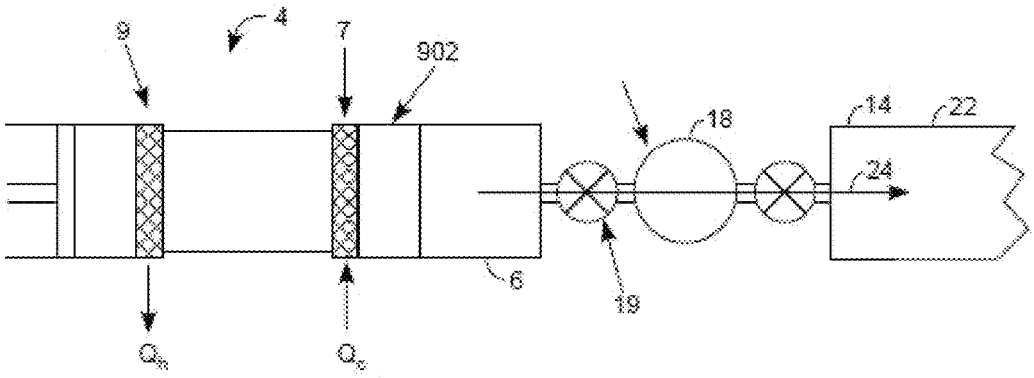
Figure 8C:
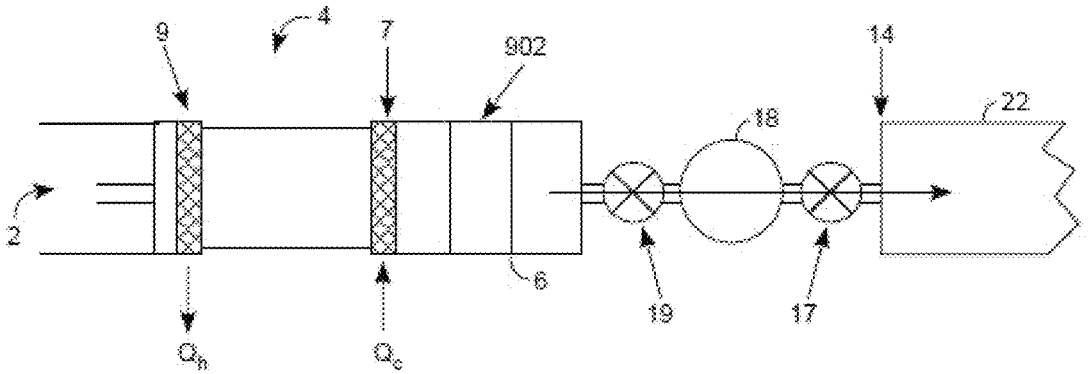
Figure 8D:
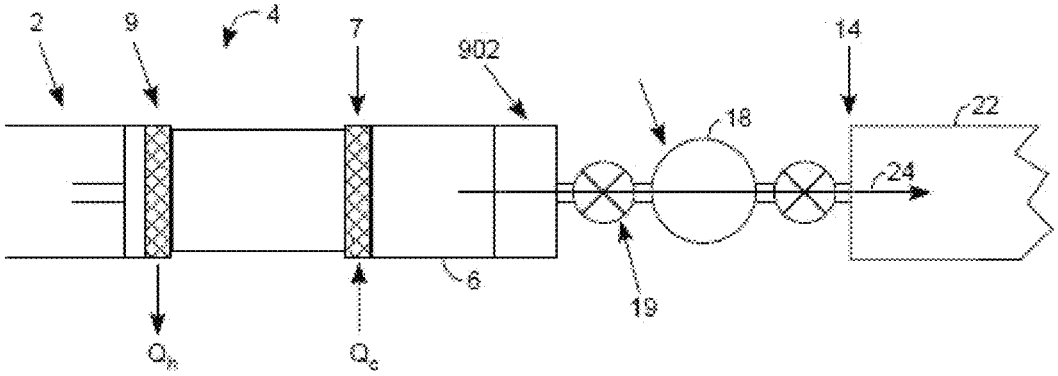

The compressor 2 may move towards the regenerator 4 from the position shown in FIG. 8A to the position shown in FIG. 8B. As this occurs, the thermodynamic cycle of the cooler 10 may proceed from (1) to (2), as shown in FIGS. 7A and 7B. Entropy of the working fluid may decrease, pressure may increase and volume may decrease. As the compressor 2 continues to move towards the regenerator 4 from the position shown in FIG. 8B to the position shown in FIG. 8C, the thermodynamic cycle of the cooler 10 may proceed from (2) to (3), as shown in FIGS. 7A and 7B. The temperature of the working fluid may decrease while entropy decreases. The pressure may decrease as the working fluid expands through the regenerator 4 and into the first stage pulse tube 6. A high pressure area 902 in the pulse tube may form and begin to propagate towards the common reservoir 18. The thermodynamic cycle may proceed from (3) to (4) as the high pressure area 902 propagates from the position shown in FIG. 8C to the position shown in FIG. 8D. The working fluid may expand further into the reservoir 18 and the hot end 22 of the second stage pulse tube 14. Pressure may continue to drop while volume increases. Entropy may increase. As the compressor 2 is reversed from the position of FIG. 8D to the position of FIG. 8A, temperature, entropy and pressure may increase, as between (4) and (1) in FIGS. 7A and 7B.

Including the fluid path 24 via phase control devices 17, 19 and common reservoir 18 may enhance the cooling during the thermodynamic cycle, for example, by increasing the ease with which the working fluid can expand between points (3) and (4). Also, fluid drawn from the cold end 20 of the first stage pulse tube 6 may cause convective and/or conductive cooling at the hot end 22 of the second stage pulse tube 14. This may lead to a lower temperature at the cold end 21 of the second stage pulse tube 14.

Figure 9:
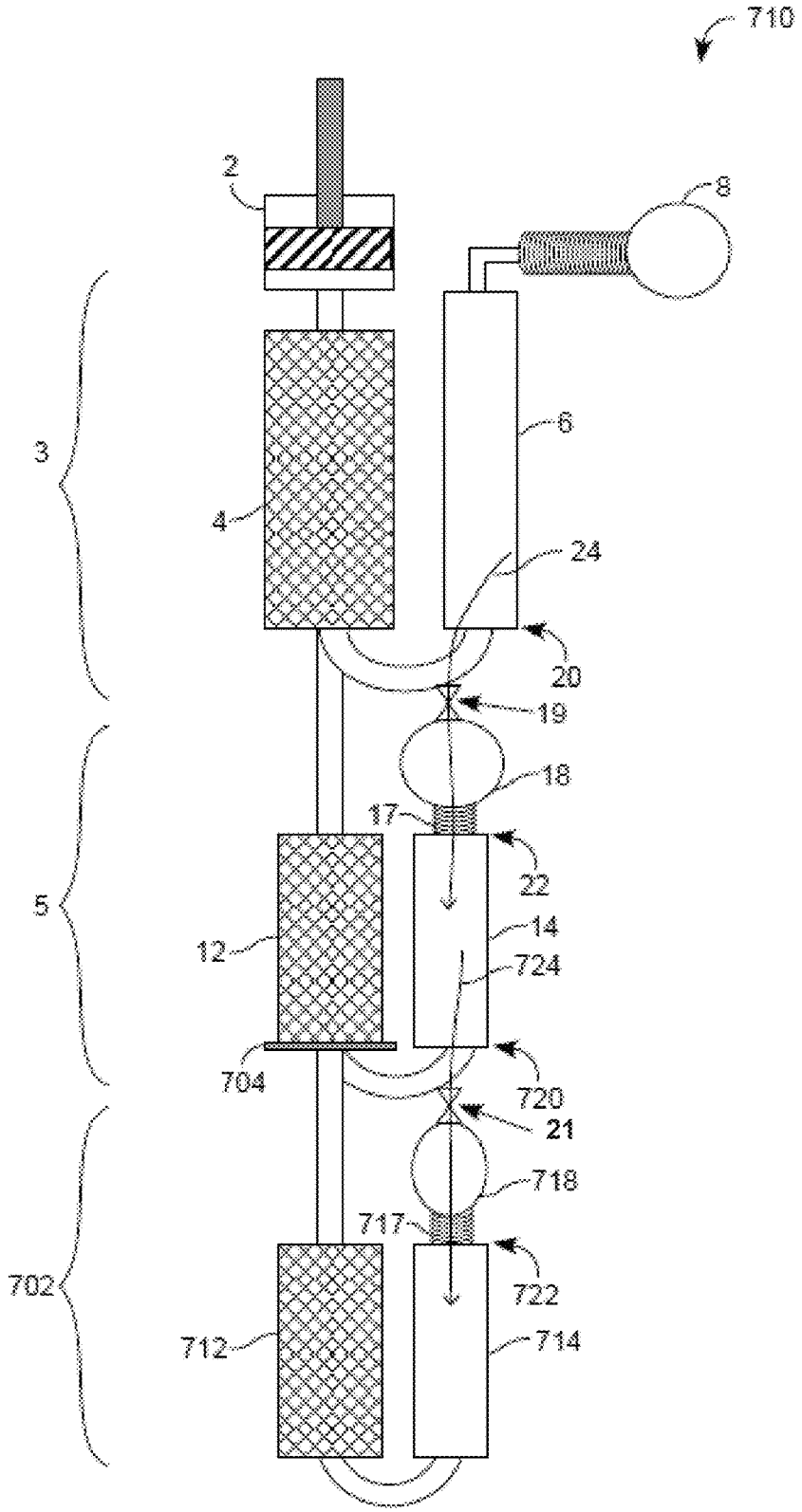
FIG. 9 illustrates one example of a pulse tube cooler comprising three stages.
Figure 10:
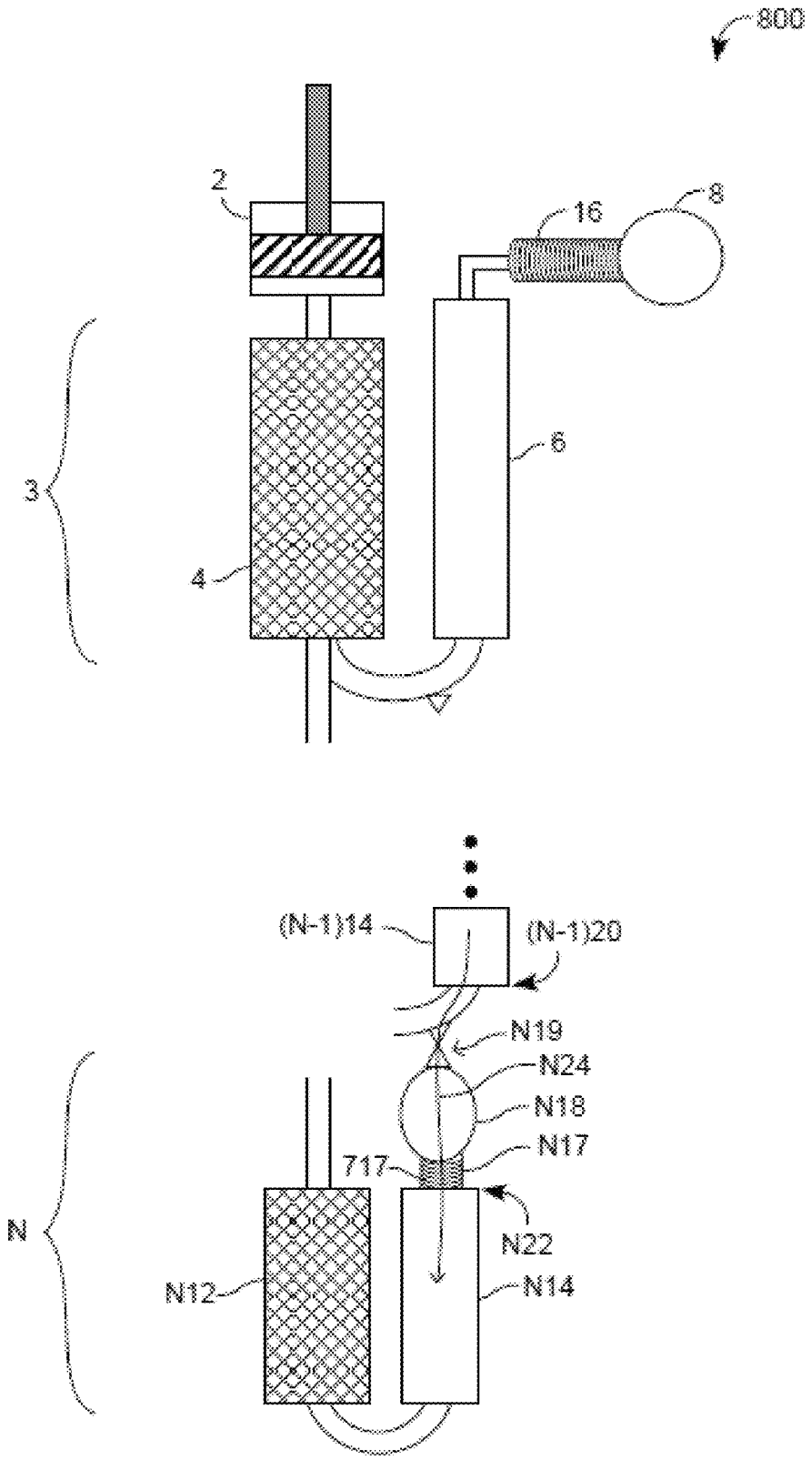
FIG. 10 illustrates one example of a multi-stage pulse tube cooler having N stages.

Common reservoirs, such as 18, may also be included on pulse tube coolers having more than two stages. FIG. 9 illustrates one example of a pulse tube cooler 710 comprising three stages 3, 5, 702. Stages 3 and 5 may be arranged as described herein above. A third stage 702 may comprise a regenerator 712, pulse tube 714 and common reservoir 718. The common reservoir 718 may be coupled between the hot end 722 of the third stage pulse tube 714 and the cold end 720 of the second stage pulse tube 14, creating a flow path 724 between the two pulse tubes 14, 714. The flow path 724 may comprise phase control devices 719, 717 as described above. Although the pulse tube cooler 710 includes common reservoirs 18, 718 between each adjacent stage, some examples may omit a common reservoir between one or more stages. Any suitable number of stages may be used. FIG. 10 illustrates one example of a multi-stage pulse tube cooler having N stages. A first stage 3 may be arranged as described herein above. A $N^{th}$ stage N may comprise a regenerator N12 and a pulse tube N14. A common reservoir N18 may be part of a flow path N24 between the hot end N22 of the $N^{th}$ stage pulse tube N14 and a cold end (N−1)20 of the $(N-1)^{th}$ stage pulse tube (N−1)14. The flow path N24 may optionally include phase control devices N17, N19.

It is to be understood that the figures and descriptions of the present invention have been simplified to illustrate elements that are relevant for a clear understanding of the present invention, while eliminating other elements, for purposes of clarity. Those of ordinary skill in the art will recognize that these and other elements may be desirable. However, because such elements are well known in the art and because they do not facilitate a better understanding of the present invention, a discussion of such elements is not provided herein.

In various embodiments disclosed herein, a single component may be replaced by multiple components and multiple components may be replaced by a single component to perform a given function or functions. Except where such substitution would not be operative, such substitution is within the intended scope of the embodiments.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

I claim:

1. A pulse tube cooler, the pulse tube cooler comprising:

a fluid compressor;

a first regenerator having a first end and a second end, wherein the first end of the first regenerator is in fluid communication with the fluid compressor;

a first pulse tube having a cold end and a hot end, wherein the cold end of the first pulse tube is in fluid communication with the second end of the first regenerator;

a first reservoir in fluid communication with the hot end of the first pulse tube;

a second regenerator having a first end and a second end, wherein the first end of the second regenerator is in fluid communication with the cold end of the first pulse tube;

a second pulse tube having a cold end and a hot end, wherein the cold end of the second pulse tube is in fluid communication with the second end of the second regenerator;

a second reservoir comprising a first opening and a second opening;

a first fluid path comprising a first end and a second end, wherein the first end of the first fluid path is directly attached to the second reservoir at the first opening, and wherein the second end of the first fluid path is directly attached to the cold end of the first pulse tube; and a second fluid path separate from the first fluid path and comprising a first end and a second end, wherein the first end of the second fluid path is directly attached to the second reservoir at the second opening, and wherein the second end of the second fluid path is directly attached to the hot end of the second pulse tube.

2. The pulse tube cooler of claim 1, wherein the second reservoir has a volume that is between about one fourth of a volume of the second pulse tube and six times the volume of the second pulse tube.

3. The pulse tube cooler of claim 1, wherein the second reservoir has a volume that is greater than fifty times a volume of the second pulse tube.

4. The pulse tube cooler of claim 1, wherein the second reservoir has a volume that is between about six and about fifty times a volume of the second pulse tube.

5. The pulse tube cooler of claim 1, wherein the second reservoir is in fluid communication with the cold end of the first pulse tube via a first phase control device.

6. The pulse tube cooler of claim 5, wherein the first phase control device is a resistive device.

7. The pulse tube cooler of claim 5, wherein the first phase control device is an inertance device.

8. The pulse tube cooler of claim 7, wherein the inertance device is selected from the group consisting of an inertance tube and an inertance gap.

9. The pulse tube cooler of claim 1, wherein the second reservoir is in fluid communication with the hot end of the second pulse tube via a second phase control device.

10. The pulse tube cooler of claim 9, wherein the second phase control device is a resistance device.

11. The pulse tube cooler of claim 9, wherein the second phase control device is an inertance device.

12. The pulse tube cooler of claim 11, wherein the inertance device is selected from the group consisting of an inertance tube and an inertance gap.

13. The pulse tube cooler of claim 1, further comprising:

a third regenerator having a first end and a second end, wherein the first end of the third regenerator is in fluid communication with the second end of the second regenerator;

a third pulse tube having a cold end and a hot end, wherein the cold end of the third pulse tube is in fluid communication with the second end of the third regenerator; and a third reservoir, wherein the cold end of the second pulse tube is in fluid communication with the third reservoir at a first location, and wherein the hot end of the third pulse tube is in fluid communication with the third reservoir at a second location.

14. A pulse tube cooler, the pulse tube cooler comprising:

a fluid compressor;

a first regenerator having a first end and a second end, wherein the pulse tube cooler comprises a fluid path between the first end of the first regenerator and the fluid compressor;

a first pulse tube having a cold end and a hot end, wherein the pulse tube cooler comprises a fluid path between the cold end of the first pulse tube and the second end of the first regenerator;

a first reservoir, wherein the pulse tube cooler comprises a fluid path between the first reservoir and the hot end of the first pulse tube;

a second regenerator having a first end and a second end, wherein the pulse tube cooler comprises a fluid path between the first end of the second regenerator and the second end of the first regenerator;

a second pulse tube having a cold end and a hot end, wherein the pulse tube cooler comprises a fluid path between the cold end of the second pulse tube and the second end of the second regenerator;

a second reservoir comprising a first opening and a second opening;

a first fluid path comprising a first end and a second end, wherein the first end of the first fluid path is directly attached to the second reservoir at the first opening, and wherein the second end of the first fluid path is directly attached to the cold end of the first pulse tube; and a second fluid path separate from the first fluid path and comprising a first end and a second end, wherein the first end of the second fluid path is directly attached to the second reservoir at the second opening, and wherein the second end of the second fluid path is directly attached to the hot end of the second pulse tube.

15. The pulse tube cooler of claim 14, wherein the second reservoir has a volume that is between about one fourth of a volume of the second pulse tube and six times the volume of the second pulse tube.

16. The pulse tube cooler of claim 14, wherein the second reservoir has a volume that is greater than fifty times a volume of the second pulse tube.

17. The pulse tube cooler of claim 14, wherein the second reservoir has a volume that is between about six and about fifty times a volume of the second pulse tube.

18. The pulse tube cooler of claim 14, wherein the fluid path between the cold end of the first pulse tube and the hot end of the second pulse tube comprises a first phase control device positioned between the second reservoir and the cold end of the first pulse tube.

19. The pulse tube cooler of claim 18, wherein the first phase control device is selected from the group consisting of a resistive device and an inertance device.

20. The pulse tube cooler of claim 14, wherein the fluid path between the cold end of the first pulse tube and the hot end of the second pulse tube comprises a second phase control device positioned between the second reservoir and the hot end of the second pulse tube.

21. The pulse tube cooler of claim 20, wherein the second phase control device is a resistance device.

22. The pulse tube cooler of claim 20, wherein the second phase control device is an inertance device.

23. The pulse tube cooler of claim 14, further comprising:

a third regenerator having a first end and a second end, wherein the pulse tube cooler comprises a fluid path between the first end of the third regenerator and the second end of the second regenerator;

a third pulse tube having a cold end and a hot end, wherein the pulse tube cooler comprises a fluid path between the cold end of the third pulse tube and the second end of the third regenerator; and a third reservoir, wherein the pulse tube cooler comprises a fluid path between the cold end of the second pulse tube and the hot end of the third pulse tube, and wherein the fluid path between the cold end of the second pulse tube and the hot end of the third pulse tube comprises the third reservoir.

24. The pulse tube cooler of claim 1, further comprising a first phase control device and a second phase control device.

25. The pulse tube cooler of claim 24, wherein the first phase control device is intermediate the second reservoir and the cold end of the first pulse tube; and the second phase control device is intermediate the second reservoir and the hot end of the second pulse tube.

26. The pulse tube cooler of claim 1, further comprising a first phase control device and a second phase control device.

27. The pulse tube cooler of claim 26, wherein the first phase control device is intermediate the second reservoir and the cold end of the first pulse tube; and the second phase control device is intermediate the second reservoir and the hot end of the second pulse tube.

* * * * *